US010434795B2

(12) United States Patent
Aihara et al.

(10) Patent No.: US 10,434,795 B2
(45) Date of Patent: Oct. 8, 2019

(54) TRANSFER APPARATUS

(71) Applicants: Yuichi Aihara, Yamanashi-ken (JP); Kota Hihara, Yamanashi-ken (JP)

(72) Inventors: Yuichi Aihara, Yamanashi-ken (JP); Kota Hihara, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/893,136

(22) Filed: Feb. 9, 2018

(65) Prior Publication Data

US 2018/0162145 A1 Jun. 14, 2018

Related U.S. Application Data

(62) Division of application No. 15/184,442, filed on Jun. 16, 2016.

(30) Foreign Application Priority Data

Jun. 19, 2015 (JP) ..... 2015-123673

(51) Int. Cl.

| | |
|---|---|
| ***B41J 11/00*** | (2006.01) |
| ***B41J 2/325*** | (2006.01) |
| ***B41J 13/12*** | (2006.01) |
| ***B65H 29/70*** | (2006.01) |

(52) U.S. Cl.

CPC ..... *B41J 11/0005* (2013.01); *B41J 2/325* (2013.01); *B41J 13/12* (2013.01); *B65H 29/70* (2013.01); *B65H 2301/51212* (2013.01); *B65H 2701/1914* (2013.01)

(58) Field of Classification Search

None

See application file for complete search history.

*Primary Examiner* — Alejandro Valencia

(74) *Attorney, Agent, or Firm* — Manabu Kanesaka

(57) ABSTRACT

A transfer apparatus includes a transfer device which performs transfer processing to transfer a transfer layer or protection layer to first and second faces of a card-shaped recording medium, a correcting device which performs decurl processing to correct a curl of the recording medium to which the transfer layer is transferred, a transfer sequence determining device which determines a transfer sequence to the first face and the second face of the recording medium, and a control device which controls the transfer device and the correcting device. The transfer sequence determining device determines the transfer sequence so that the transfer processing is performed alternately on the first face and the second face at least once. The control device performs the decurl processing with the correcting device for the difference between the number of times of the transfer processing on the first face and the second face of the recording medium.

3 Claims, 13 Drawing Sheets

FIG. 11
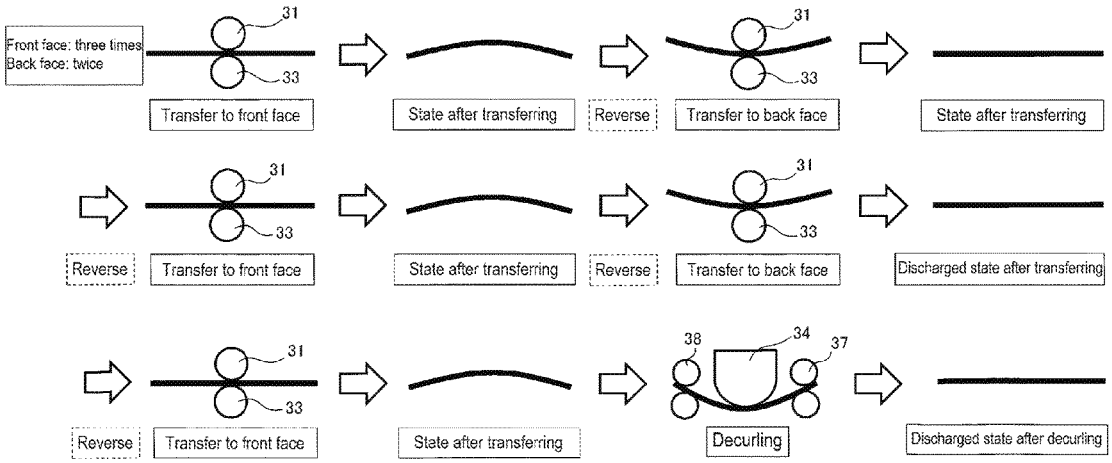
FIG. 12
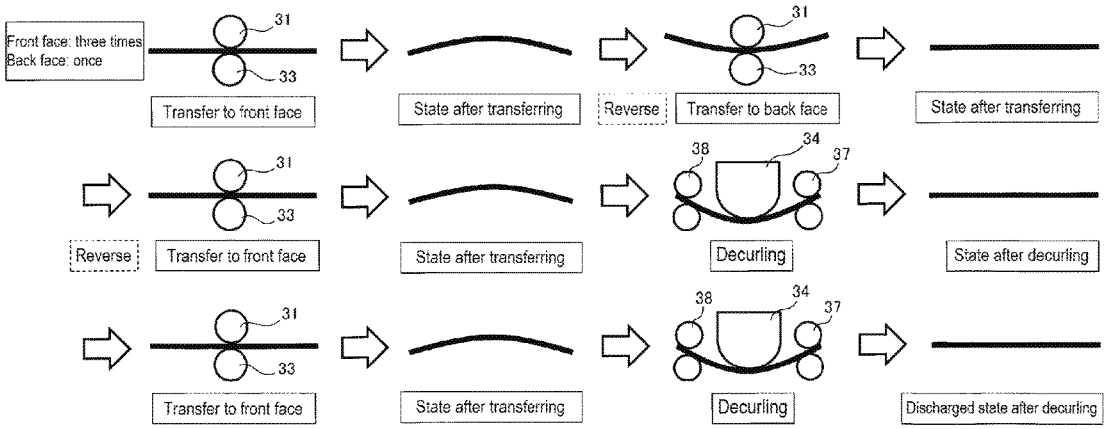
FIG. 13
| Front face: once<br>Back face: once | First | Second | Number of times of decurling |
|---|---|---|---|
| Pattern 1 | Front | Back | o |
| Pattern 2 | Back | Front | o |

FIG. 14

| Front face: twice<br>Back face: once | First | Second | Third | Number of times of decurling |
|---|---|---|---|---|
| Pattern 1 | Front | Back | Front | 1 |
| Pattern 2 | Back | Front | Front | 1 |
| Pattern 3 | Front | Front | Back | 1 |

FIG. 15

| Front face: twice<br>Back face: twice | First | Second | Third | Fourth | Number of times of decurling |
|---|---|---|---|---|---|
| Pattern 1 | Front | Back | Front | Back | 0 |
| Pattern 2 | Back | Front | Back | Front | 0 |
| Pattern 3 | Front | Back | Back | Front | 0 |
| Pattern 4 | Back | Front | Front | Back | 0 |
| NG pattern | Front | Front | Back | Back | 2 |
| NG pattern | Back | Back | Front | Front | 2 |

FIG. 16

| Front face: three times<br>Back face: twice | First | Second | Third | Fourth | Fifth | Number of times of decurling |
|---|---|---|---|---|---|---|
| Pattern 1 | Front | Back | Front | Back | Front | 1 |
| Pattern 2 | Front | Back | Back | Front | Front | 1 |
| Pattern 3 | Back | Front | Front | Back | Front | 1 |
| Pattern 4 | Back | Front | Back | Front | Front | 1 |
| Pattern 5 | Front | Front | Back | Front | Back | 1 |
| Pattern 6 | Back | Front | Front | Front | Back | 1 |
| Pattern 7 | Front | Front | Back | Back | Front | 1 |
| NG pattern 1 | Front | Front | Front | Back | Back | 3 |
| NG pattern 2 | Back | Back | Front | Front | Front | 3 |

FIG. 17

| Front face: three times<br>Back face: once | First | Second | Third | Fourth | Number of times of decurling |
|---|---|---|---|---|---|
| Pattern 1 | Front | Back | Front | Front | 2 |
| Pattern 2 | Back | Front | Front | Front | 2 |
| Pattern 3 | Front | Front | Back | Front | 2 |
| Pattern 4 | Front | Front | Front | Back | 2 |

TRANSFER APPARATUS

CROSS-REFERENCE TO RELATED APPLICATION

This is a divisional application of Ser. No. 15/184,442 filed on Jun. 16, 2016, which claims priority of Japanese Patent Application No. 2015-123673 filed on Jun. 19, 2015, the disclosure of which is incorporated herein.

BACKGROUND OF THE INVENTION

1. Field of the Invention

The present invention relates to a transfer apparatus, and in particular, relates to a transfer apparatus which transfers an image to a card-shaped recording medium.

2. Description of Related Art

Conventionally, there has been widely known a transfer apparatus which transfers an image (mirror image) formed on a transfer film to a card using a heat roller (HR). In general, in such a transfer apparatus, a configuration in which a transfer film and a card are conveyed simultaneously (at the same speed) while a face of the transfer film at the opposite side of a transfer layer is pressed by a heat roller is adopted.

In such a transfer apparatus, transfer processing is performed by applying heat to the card and the transfer film with the heat roller to transfer the transfer layer of the transfer film to the card, and peeling the transfer film from the card. Then, a curl occurs with contraction of the transfer film as the transferred card and the transfer film get cooled. Accordingly, the transfer apparatus includes a decurl mechanism to correct a curl of the card and decurl processing is performed to correct a curl of the card using the decurl mechanism after an image is transferred to the card.

For example, Japanese Patent Application Laid-open No. 2011-136783 discloses a technology to perform decurl processing on a card by pressing down a decurl unit (pressing member) for a time set by a user after conveying the card to a decurl mechanism and stopping the card at a central arrival point. In this technology, as illustrated in FIG. 20, a curl of a card, where the card has an image transferred on one face (lower face in FIG. 12) side, is corrected (removed) by pressing the other face (upper face in FIG. 12) side of the card having a curl with a pressing member configuring the decurl mechanism for a predetermined time. Then, the card is rotated by 180 degrees (i.e., faces are reversed) and an image is transferred to the other face (lower face in FIG. 12) side, and then, the one face (upper face in FIG. 12) side having a curl is pressed for a predetermined time by the pressing member. Thus the curl is corrected. According to the technology disclosed in Japanese Patent Application Laid-open No. 2011-136783, a card with excellent handling and good-looking is provided by correcting a curl of the card with a decurl unit for each time after transfer processing is performed.

Further, in Japanese Patent Application Laid-open No. 2008-080682, transfer processing is performed for a plurality of times on one face of a card with a transfer apparatus which transfers an image formed on a transfer film to the card using a heat roller.

SUMMARY OF THE INVENTION

In the decurl mechanism of Japanese Patent Application Laid-open No. 2011-136783, a curl is corrected by pressing a card with the pressing member in a direction opposite to the curling direction.

Accordingly, damage to the card increases as the pressing time is elongated and the card is pressed for a plurality of times with load put on the card. For example, in the technology disclosed in Japanese Patent Application Laid-open No. 2008-080682, since transfer processing is performed for a plurality of times on one face of a recording medium, decurl processing has to be performed for a plurality of times on the card if decurl processing is performed for each time after transfer processing is performed as disclosed in Japanese Patent Application Laid-open No. 2011-136783. Here, there is a fear that damage to the card may increase.

In view of the above, an object of the present invention is to provide a transfer apparatus capable of effectively correcting a curl of a card-shaped recording medium and prevent deterioration of the card-shaped recording medium.

In view of the above, a transfer apparatus of the present invention includes a transfer device which performs transfer processing to transfer a transfer layer of a transfer film or a protection film to both a first face and a second face of a card-shaped recording medium, for a plurality of times on at least one of the first face and the second face, a correcting device which performs decurl processing to correct a curl of the recording medium to which the transfer layer is transferred with the transfer device, a transfer sequence determining device which determines transfer sequence to the first face and the second face of the recording medium, and a control device which controls the transfer device, the correcting device, and the transfer sequence determining device, wherein the control device determines the transfer sequence so that transfer processing is performed alternately on the first face and the second face of the recording medium for at least once and the number of times to perform decurl processing with the correcting device is smaller than the number of times to perform transfer processing.

According to the present invention, since decurl processing is unnecessary to be performed for each time after transfer processing is performed owing to that transfer sequence and timing of decurl processing is controlled with the control device, an effect can be achieved such that damage to a card can be lessened as the number of times of decurl processing is reduced.

BRIEF DESCRIPTION OF THE DRAWINGS

FIGS. 3A and 3B are explanatory views of a principle of image transferring, while FIG. 3A illustrates a state in which a transfer member, a peeling member, and a supporting member are placed respectively at an operating position, and FIG. 3B illustrates a state in which the above are placed respectively at a retracting position.

FIGS. 5A to 5C are explanatory views schematically illustrating decurl operation of a decurl mechanism of the printing apparatus according to the embodiment, while FIG. 5A illustrates a state in which the pressing member is placed at the retracting position being separated from the supporting member, FIG. 5B illustrates a decurl state in which the pressing member proceeds to the supporting member, and FIG. 5C illustrates a state in which the pressing member presses the supporting member to the utmost extent among the decurl states illustrated in FIG. 5B.

FIG. 11 is an explanatory view of operation during transfer processing according to the embodiment illustrating an example of a case that transfer processing is performed for three times on the front face of the card and twice on the back face.

FIG. 12 is an explanatory view of operation during transfer processing according to the embodiment illustrating an example of a case that transfer processing is performed for three times on the front face of the card and once on the back face.

FIG. 13 is a chart showing patterns of sequence of transfer processing and number of times of decurling, in a case that transfer processing is performed once on the front face of the card and once on the back face.

FIG. 14 is a chart showing patterns of sequence of transfer processing and number of times of decurling, in a case that transfer processing is performed twice on the front face of the card and once on the back face.

FIG. 15 is a chart showing patterns of sequence of transfer processing and number of times of decurling, in a case that transfer processing is performed twice on the front face of the card and twice on the back face.

FIG. 16 is a chart showing patterns of sequence of transfer processing and number of times of decurling, in a case that transfer processing is performed for three times on the front face of the card and twice on the back face.

FIG. 17 is a chart showing patterns of sequence of transfer processing and number of times of decurling, in a case that transfer processing is performed for three times on the front face of the card and once on the back face.

DETAILED DESCRIPTION OF THE PREFERRED EMBODIMENT

In the following, description will be provided on embodiments in which the present invention is applied to a printing apparatus which prints a character or an image on a card (card-shaped recording medium made of PVC material or the like) and magnetically or electrically records information in the card.

[System Configuration]

Figure 1:
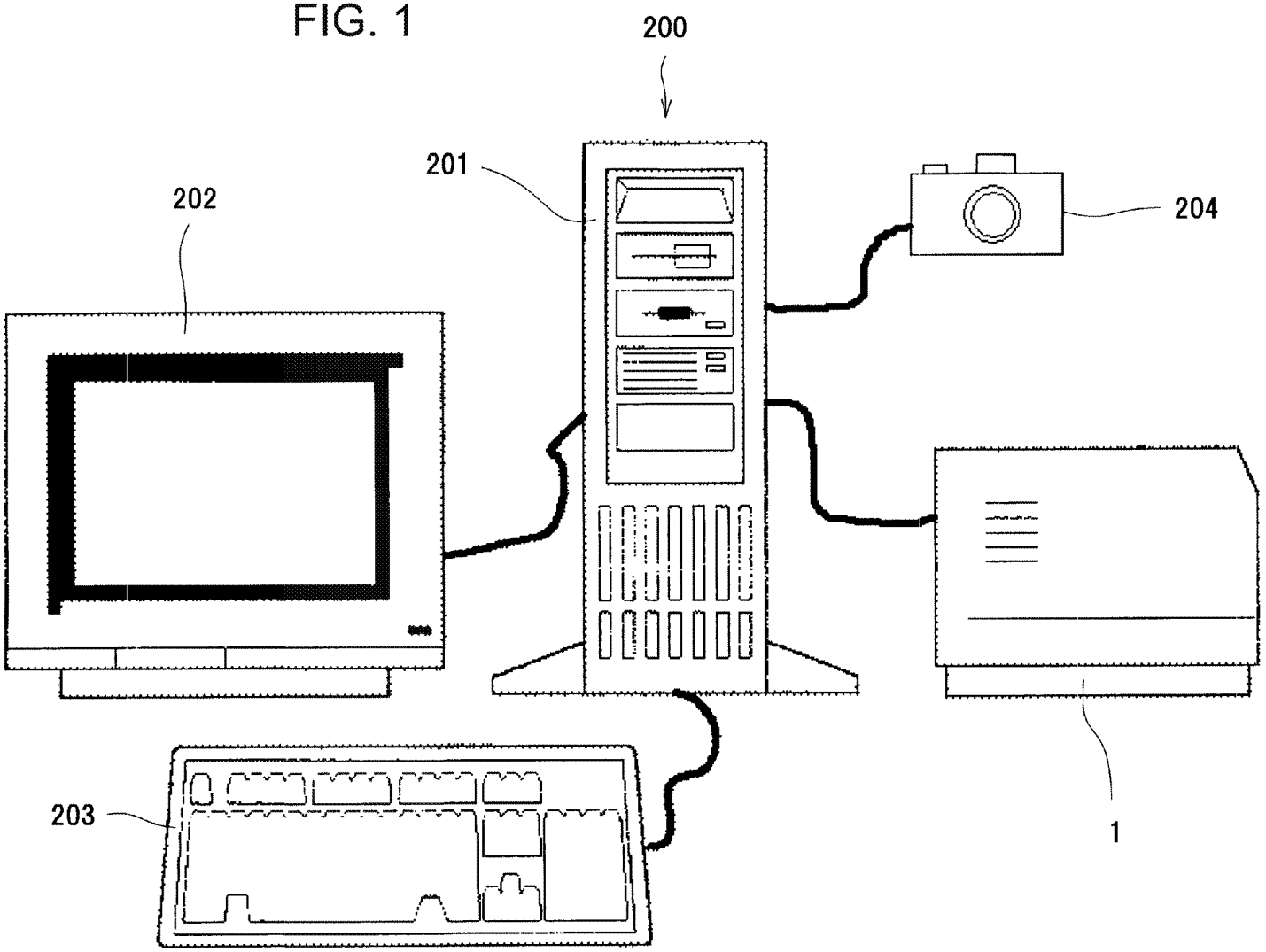
FIG. 1 is an external view of a printing system including a printing apparatus according to an applicable embodiment of the present invention.
Figure 6:
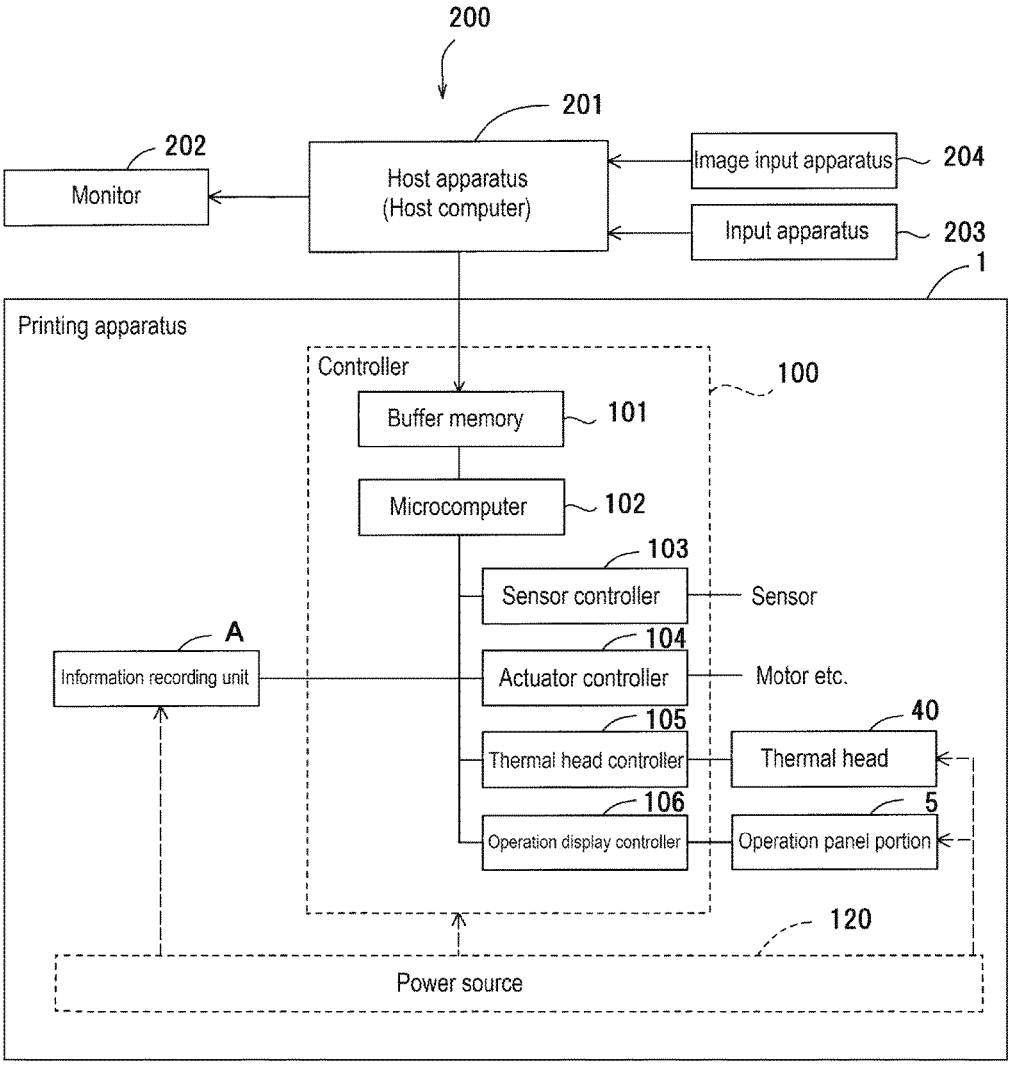
FIG. 6 is a block diagram illustrating a schematic structure of a controller of the printing apparatus according to the embodiment.

As illustrated in FIG. 1 and FIG. 6, a printing apparatus 1 of the present embodiment structures a part of a printing system 200. That is, the printing system 200 is structured with a host apparatus 201 (i.e., a host computer such as a personal computer) and the printing apparatus 1, divided roughly.

The printing apparatus 1 is connected to the host apparatus 201 via an unillustrated interface. It is possible to send image data, magnetically or electrically recorded data, and the like and to instruct recording operation and the like from the host apparatus 201 to the printing apparatus 1. Here, the printing apparatus 1 includes an operation panel (operation displaying portion) 5 (see FIG. 6). Recording operation and the like can be instructed from the operation panel 5 in addition to instructing from the host apparatus 201.

An image input apparatus 204 such as a digital camera and a scanner, an input apparatus 203 such as a keyboard and a mouse to input a command and data to the host apparatus 201, and a monitor 202 such as a liquid crystal display which displays data and the like generated by the host apparatus 201 are connected to the host apparatus 201.

[Printing Apparatus]

Figure 2:
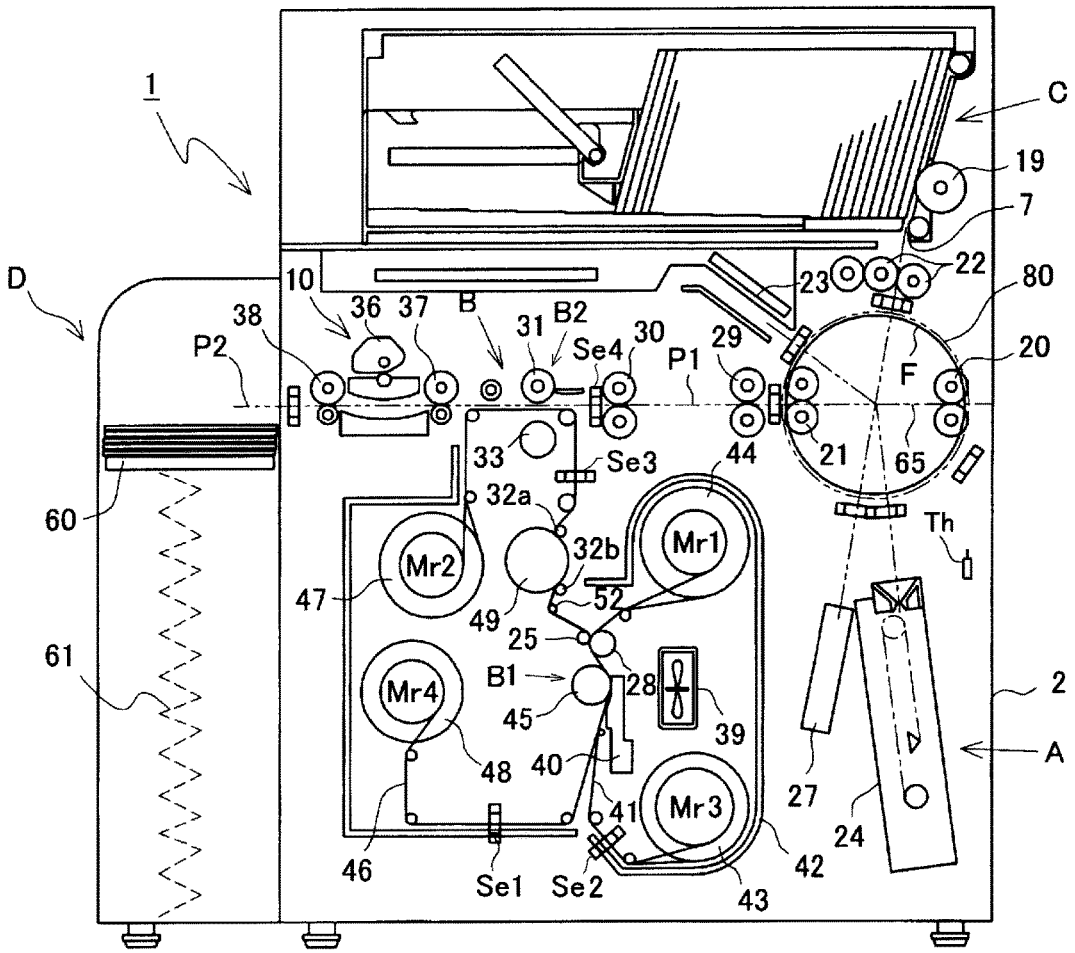
FIG. 2 is a schematic structural view of the printing apparatus according to an embodiment.

As illustrated in FIG. 2, the printing apparatus 1 includes a housing 2. An information recording unit A, a printing unit B, a medium accommodating unit C, an accommodating unit D, and a rotating unit F are provided in the housing 2.

[Information Recording Unit]

The information recording unit A is structured with a magnetic recording portion 24, a non-contact type IC recording portion 23, and a contact type IC recording portion 27.

[Medium Accommodating Unit]

The medium accommodating unit C accommodates a plurality of cards aligned in a standing posture. A separating opening 7 is arranged at a leading end of the medium accommodating unit C and a foremost card is sequentially fed out and supplied with a pickup roller 19.

[Rotating Unit]

A blank card fed out is sent to the rotating unit F with a conveying roller 22. The rotating unit F is structured with a rotating frame 80 which is axially supported by the housing 2 in a rotatable manner, and two roller pairs 20, 21 supported by the rotating frame 80. The roller pairs 20, 21 are axially supported by the rotating frame 80 in a rotatable manner.

The magnetic recording portion 24, the non-contact type IC recording portion 23, and the contact type IC recording portion 27, described above, are arranged at the outer circumference of a rotation of the rotating unit F. The roller pairs 20, 21 form a medium conveying path 65 for conveying a card to any one of the information recording portions 23, 24, 27. Data is magnetically or electrically written to the card at the information recording portion 23, 24, 27. Here, a temperature sensor Th such as a thermistor which detects environmental temperature (outer temperature) is arranged in the vicinity of the rotating unit F.

[Printing Unit]

The printing unit B forms an image such as a head shot and character data on front-back faces of a card. A medium conveying path P1 to convey a card onto the extension of the medium conveying path 65 is arranged at the printing unit B. Further, conveying roller pairs 29, 30 which convey a card are arranged at the medium conveying path P1 and an unillustrated conveying motor is connected thereto.

The printing unit B includes a film-shaped medium conveying mechanism, an image forming unit B1 which forms an image on a transfer film 46 conveyed by the conveying mechanism with a thermal head 40, and a transfer unit B2 which transfers the image formed on the transfer film 46 to a surface of a card at the medium conveying path P1 with a heat roller 33.

A medium conveying path P2 which conveys a printed card to an accommodating stacker 60 is arranged at the downstream side of the printing unit B on the extension of the medium conveying path P1. Conveying roller pairs 37, 38 which convey a card are arranged at the medium conveying path P2 and an unillustrated conveying motor is connected thereto.

A decurl mechanism 10 is arranged between the conveying roller pair 37 and the conveying roller pair 38. The decurl mechanism 10 corrects a curl occurred on a card due to thermal transfer with the heat roller 33 by pressing a center part of the card being nipped by the conveying roller pairs 37, 38 at both ends. The decurl mechanism 10 includes an eccentric cam 36 and is structured as being capable of moving in a vertical direction in FIG. 2. Detailed description will be provided later.

[Accommodating Unit]

The accommodating unit D is structured to accommodate a card in the accommodating stacker 60 sent from the printing unit B. The accommodating stacker 60 is structured to move downward in FIG. 2 with a lifting mechanism 61.

[Detail of Printing Unit]

Next, the printing unit B in the whole structure of the abovementioned printing apparatus 1 will be further described in detail.

The transfer film 46 is belt-shaped having a width slightly wider than the width of a card. The transfer film 46 is formed by layering an ink receptor layer which receives ink of an ink ribbon 41, a transparent protection layer which protects the surface of the ink ribbon layer, a peeling layer which stimulates to integrally peel the ink receptor layer and the protection layer with heating, and a base material (base film) in this order from the above. The ink receptor layer and the protection layer are collectively called a transfer layer.

The transfer film 46 is wound and fed respectively with a winding roller and a feeding roller which rotate in a transfer film cassette by driving motors Mr2, Mr4. That is, in the transfer film cassette, a winding spool 47 is arranged at the center of the winding roller and the supplying spool 48 is arranged at the center of the feeding roller. Rotational driving force of the motor Mr2 is transmitted to the winding spool 47 via an unillustrated gear and rotational driving force of the motor Mr4 is transmitted to the supplying spool 48 via an unillustrated gear. A film conveying roller 49 is a main driving roller for conveying the transfer film 46. Conveying amount and convey stopping position of the transfer film 46 are determined by controlling the driving of the film conveying roller 49. The film conveying roller 49 is connected to an unillustrated stepping motor. The motors Mr2, Mr4 are driven when the film conveying roller 49 is driven. However, the motors Mr2, Mr4 are intended to be driven to wind the transfer film 46 with one of the winding spool 47 or the supplying spool 48 fed from the other thereof but are not driven to subjectively convey the transfer film 46. Here, a DC motor capable of forward-reverse driving is used for each of the motors Mr2, Mr4.

A pinch roller 32*a* and a pinch roller 32*b* are arranged at the circumferential face of the film conveying roller 49. Although not illustrated in FIG. 2, the pinch rollers 32*a*, 32*b* are structured to be capable of moving to proceed to and retract from the film conveying roller 49. FIG. 2 illustrates a state that the pinch rollers 32*a*, 32*b* proceed to the film conveying roller 49 so that the transfer film 46 is pressure-contacted and wound to the film conveying roller 49. Thus, the transfer film 46 is accurately conveyed by a distance corresponding to a number of rotations of the film conveying roller 49.

The ink ribbon 41 is accommodated in an ink ribbon cassette 42 in a stretched state between a supplying spool 43 which supplies the ink ribbon 41 to the ink ribbon cassette 42 and a winding spool 44 which winds the ink ribbon 41. The winding spool 44 is rotated by driving force of a motor Mr1 and the supplying spool 43 is rotated by driving force of a motor Mr3. A DC motor capable of forward-reverse driving is used for each of the motors Mr1, Mr3. Here, the temperature sensor Th such as a thermistor which detects environmental temperature of the motors Mr1, Mr3 is arranged between the motor Mr1 and the motor Mr3.

The ink ribbon 41 is configured to sequentially feed faces of color ribbon panels of yellow (Y), magenta (M), and cyan (C) and a black (B) ribbon panel in the longitudinal direction. Here, the ink ribbon 41 may be configured to sequentially feed faces of ultraviolet (UV) or another black ribbon panel in addition to the color ribbon panels of yellow (Y), magenta (M), and cyan (C) and the black (B) ribbon panel in the longitudinal direction depending on types. An empty mark indicating application limits of the ink ribbon 41 is set at a termination of the ink ribbon 41. Se2 indicated in FIG. 2 is a transparent sensor to detect the empty mark.

The image forming unit B1 is structured with a platen roller 45 and the thermal head 40. The thermal head 40 is arranged at a position faced to the platen roller 45. The thermal head 40 includes heating elements arranged in lines in a main scanning direction. The heating elements are selectively heat controlled with an unillustrated head control IC in accordance with printing data and an image is printed on the transfer layer of the transfer film 46 via the ink ribbon 41. A cooling fan 39 is provided to cool the thermal head 40.

The ink ribbon 41 with which printing to the transfer film 46 is completed is peeled from the transfer film 46 with a peeling roller 25 and a peeling member 28. The peeling member 28 is fixed to the ink ribbon cassette 42. The peeling roller 25 is abutted to the peeling member 28 at the time of printing and peeling is performed by nipping the transfer film 46 and the ink ribbon 41 with the peeling roller 25 and the peeling member 28. Then, the peeled ink ribbon 41 is wound by the winding spool 44 with the driving force of the motor Mr1 and the transfer film 46 is conveyed, with the film conveying roller 49, to the transfer unit B2 which includes a platen roller 31 and the heat roller 33.

At the transfer unit B2, the transfer film 46 is nipped by the heat roller 33 and the platen roller 31 along with a card.

Then, the image formed on the transfer layer of the transfer film 46 is transferred to the card. When starting transfer processing, the transfer film 46 is placed at a transfer starting position as being conveyed by a predetermined distance after a mark formed on the transfer film 46 is detected by a sensor Se3. The front end of the card is placed at the transfer starting position as being conveyed by a predetermined distance after the front end of the card is detected by a sensor Se4. Thus, positioning of the transfer film 46 and the card is performed and transfer processing is started. Here, the heat roller 33 is attached to an unillustrated lifting mechanism to pressure-contact to and be separated from the platen roller 31 via the transfer film 46.

Figure 3A:
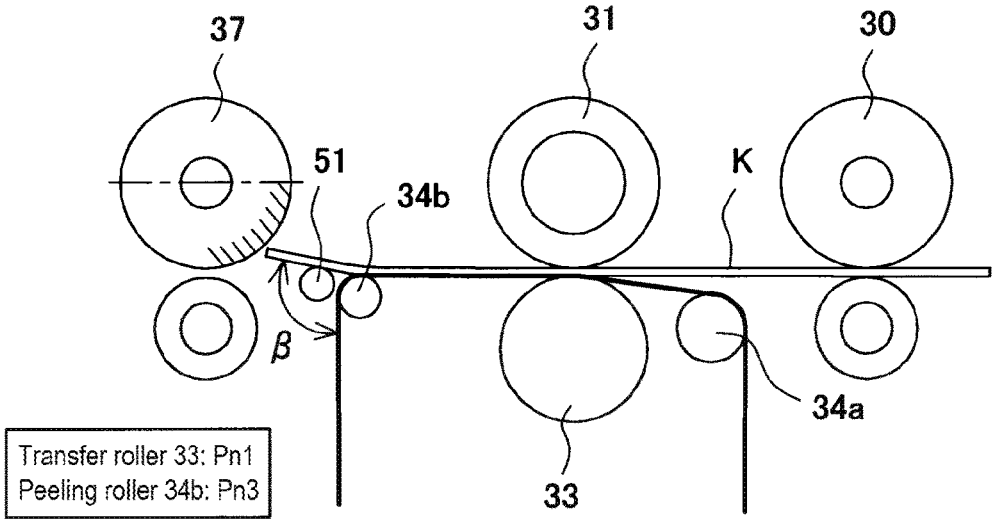
Figure 3B:
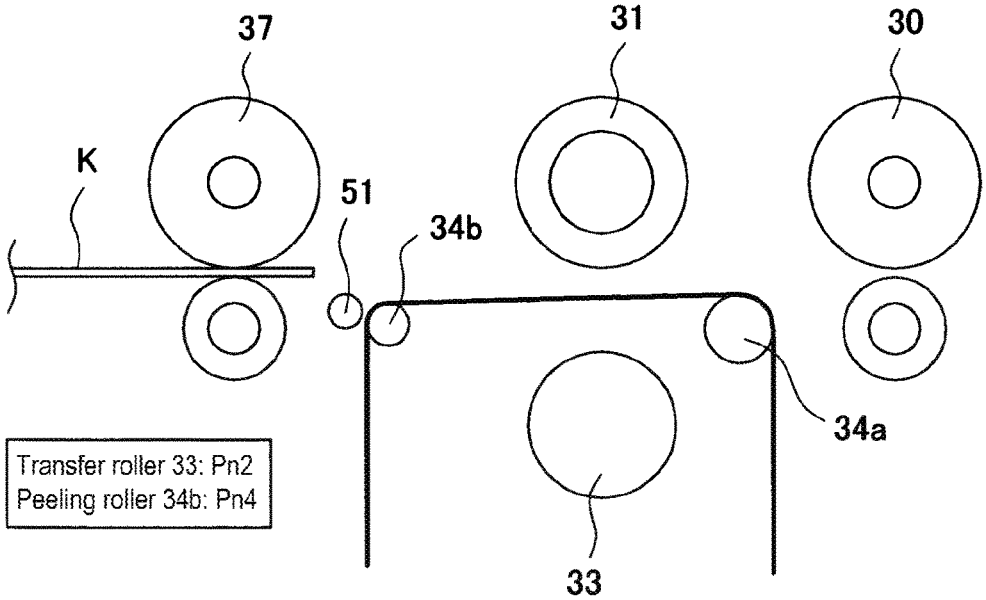

The transfer roller 33, a peeling roller 34*b*, and a supporting pin 51 are structured to be capable of moving respectively to an operating position illustrated in FIG. 3A and a retracting position illustrated in FIG. 3B with an unillustrated lifting mechanism. The peeling roller 34*b* and the supporting pin 51 are arranged at the transfer film cassette. The peeling roller 34*b* moves to the operating position and the retracting position while supporting the transfer film 46. The peeling roller 34*b* at the operating position is set to contact to the card conveyed along the conveying path P1 via the transfer film 46. The transfer film 46 being transferred to the card adheres to the card from the position of the transfer roller 33 to the peeling roller 34*b* and is peeled from the card when the card reaches the position of the peeling roller 34*b*. Since the peeled transfer film 46 is wound to a direction perpendicular to the card (downward in FIG. 2), the card and the peeled transfer film 46 are kept in a relation of approximately 90 degrees via the peeling roller 34*b*. That is, a peeling angle β is approximately 90 degrees.

A later-mentioned controller 100 moves the transfer roller 33 to the operating position (Pn1) to pressure-contact the card when transferring an image to the card and moves the transfer roller 33 to the retracting position (Pn2) to be separated from the card after forming the image (after the rear end of the card passes the transfer roller 33). Accordingly, deformation of the transfer film 46 due to the heat of the transfer roller (heat roller) 33 can be prevented as the transfer film 46 is prevented from being contacted to the transfer roller 33 after the rear end of the card passes the transfer roller 33.

The controller 100 moves the peeling roller 34*b* and the supporting pin 51, respectively, from the operating position (Pn3) to the retracting position (Pn4) at the timing when the rear end of the card passes the supporting pin 51. Here, since the peeling roller 34*b* and the supporting pin 51 are moved respectively to the retracting position, collision of the card with the supporting pin 51 and the peeling roller 34*b* is prevented when the card is switch back conveyed to a reverse unit F at the upstream side of the conveying path for duplex printing. According to such control, there is not a fear that excessive heat effects to deform the transfer film and transfer malfunction does not occur when peeling the transfer film 46.

In the present embodiment, transfer processing is performed for a plurality of times at least on one face of the card at the transfer unit B2. For example, in a case that a color image and the protection layer is transferred to a front face (first face) of the card and a black-and-white image is transferred to a back face (second face) of the card, transfer processing is performed twice on the front face and once on the back face at the transfer unit B2. Here, transferring the protection layer is to coat the card by transferring the transfer layer of the transfer film 46 at the transfer unit B2 without forming an image at the image forming unit B1. Further, in a case that a UV ink image, a color image, and the protection layer are transferred to the front face and a black-and-white image and the protection layer are transferred to the back face, transfer processing is performed for three times on the front face and twice on the back face at the transfer unit B2. The above can be arbitrarily set by a user. For example, transfer processing may be performed twice on the front face and twice on the back face, or once on the front face and three times on the back face.

Figure 4:
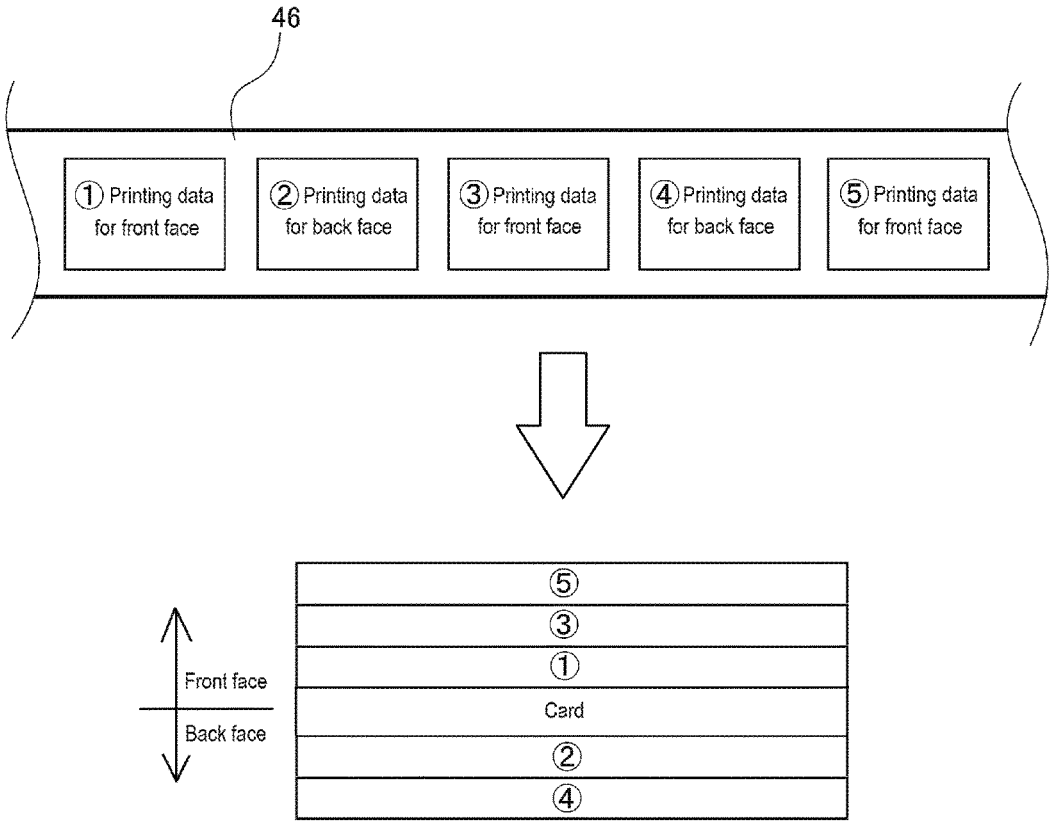
FIG. 4 is a view illustrating a card issued by the printing apparatus according to the embodiment and a sequence of primary transferring to perform transfer processing on the card.

For example, in a case that transfer processing is performed for three times on the front face of the card and twice on the back face, as illustrated in FIG. 4, at the image forming unit B1, printing data for the front face is formed at three parts on the transfer film 46 and at two parts for the back face. Then, transfer processing is performed for a plurality of times on the card at the transfer unit B2, and then, the card is issued. In the example illustrated in FIG. 4, transfer processing is performed in the order of the front face 1, the back face 1, the front face 2, the back face 2, and the front face 3. Accordingly, image forming is performed on the transfer film 46 in the same order. That is, the order of printing on the transfer film 46 at the image forming unit B1 varies in accordance with the order of performing transfer processing on the card at the transfer unit B2. Here, in a case that transfer processing is performed on the same face of the card for a plurality of times, image forming on the transfer film 46 is performed from printing data close to the card.

[Detail of Decurl Mechanism]

Figure 5A:
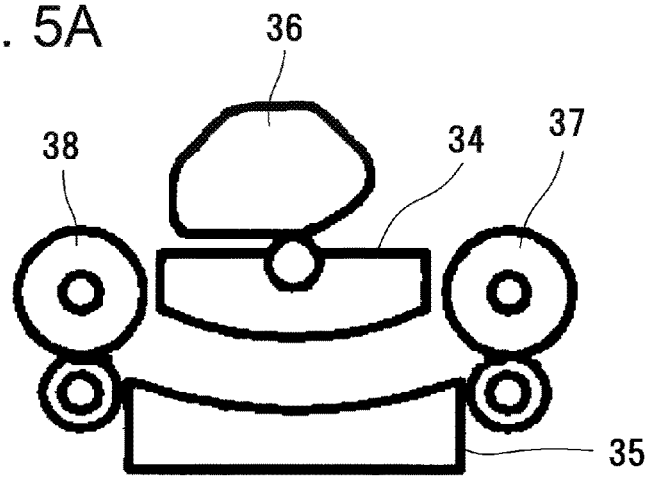
Figure 5B:
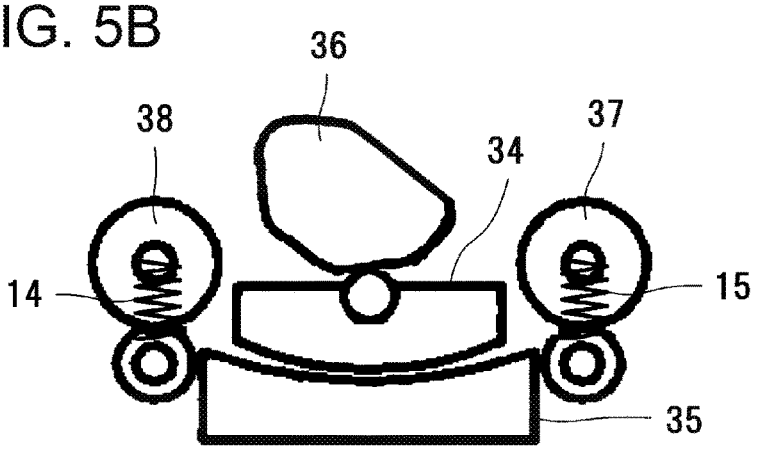
Figure 5C:
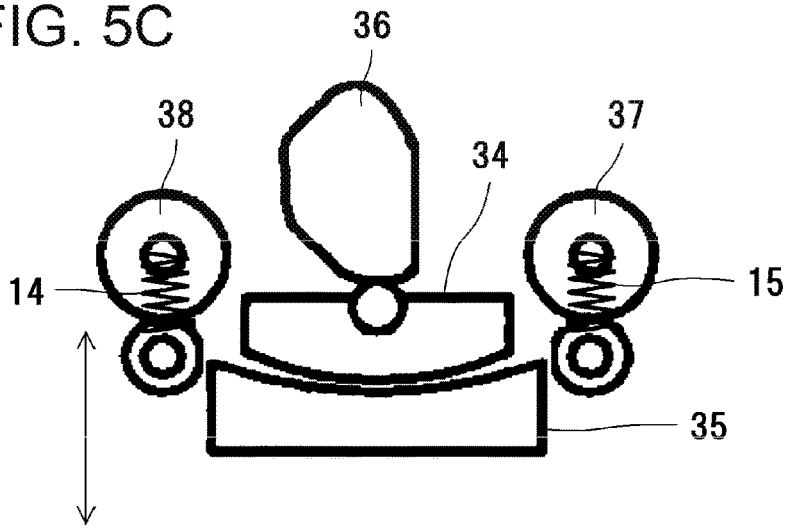

Next, the abovementioned decurl mechanism 10 will be described in detail. As illustrated in FIGS. 5A to 5C, the decurl mechanism 10 includes the eccentric cam 36, the pressing member 34 which has a convex curved face, and a supporting member 35 which has a concave curved face corresponding to the curved face of the pressing member 34.

As illustrated in FIG. 5A, when the decurl mechanism 10 is not in operation, the pressing member 34 is positioned at a retracting position and the pressing member 34 and the supporting member 35 are arranged to be separated as facing each other via the medium conveying path P2 (see FIG. 2). A roller is fixedly attached to the pressing member 34 at the center part of a face opposite to the convex curved face and the roller is abutted to the circumferential face of the eccentric cam 36. Rotational driving force of an unillustrated motor is transmitted to the axis center of the eccentric cam 36 (see FIG. 2) via unillustrated gears.

The eccentric cam 36 is rotated with the rotational driving force of the unillustrated motor transmitted to the axis center of the eccentric cam 36 while the card is nipped at both ends thereof by the conveying roller pairs 37, 38. Thus, as illustrated in FIG. 5B, the pressing member 34 proceeds to the supporting member 35 side crossing over the medium conveying path P2. Accordingly, in the present embodiment, the card is sandwiched between the concave curved face of the supporting member 35 and the convex curved face of the pressing member 34, and a curl opposite to a curl of the card is applied to the card by the pressing member 34 and the supporting member 35, so that the curl of the card is corrected.

FIG. 5C illustrates a state in which the pressing member 34 presses the supporting member 35 to the utmost extent among the decurl states illustrated in FIG. 5B. Driven rollers (rollers at the lower side in FIG. 5C) which constitute the supporting member 35 and the conveying roller pairs 37, 38 are arranged in a slidable manner in a direction intersecting with the medium conveying path P2 as an arrow indicated in FIG. 5C (the vertical direction in FIG. 5C) and are urged to the pressing member 34 side with springs 14, 15. Here, the supporting member 35 is fixed to a bearing of the conveying roller pairs 37, 38 at the driven roller side. In the present embodiment, the time of decurl processing is set to 10 seconds for each time. However, the time of decurl processing can be appropriately set in accordance with a material and thickness of the card or environmental temperature. The time of decurl processing can be determined so that a curl of the card is corrected while negative influence to conveying of the card and transfer processing does not occur.

Next, the control and electrical system of the printing apparatus 1 will be described. As illustrated in FIG. 6, the printing apparatus 1 includes a controller 100 which controls the whole operation of the printing apparatus 1, and a power source 120 which converts commercial alternating current power source to a direct current power source being capable of driving and operating each of mechanisms, controller, and the like.

[Controller]

As illustrated in FIG. 6, the controller 100 includes a microcomputer 102 which performs control processing of the whole printing apparatus 1. The microcomputer 102 is structured with a CPU which operates as a central processing unit at high-speed clock, a ROM which stores a program and program data of the printing apparatus 1, a RAM which functions as a work area of the CPU, and an internal bus which connects the above.

The microcomputer 102 is connected to an external bus. The external bus is connected to an unillustrated interface which communicates with the host apparatus 201, and a buffer memory 101 which temporary stores printing data to be printed on a card and record data to be magnetically or electrically recorded on a magnetic stripe or an accommodating IC of a card.

Further, the external bus is connected to a sensor controller 103 which controls a signal from various sensors, an actuator controller 104 which includes a motor driver for supplying drive pulse and drive power to each of motors, a thermal head controller 105 which controls thermal energy supplied to the heating elements structuring the thermal head 40, an operation display unit 106 which controls the operation panel 5, and the information recording unit A described above.

[Power Source]

The power source 120 supplies operating and driving power to the controller 100, the thermal head 40, the heat roller 33, the operation panel 5, and the information recording unit A.

[Transfer Sequence and Decurl Processing]

Figure 20:
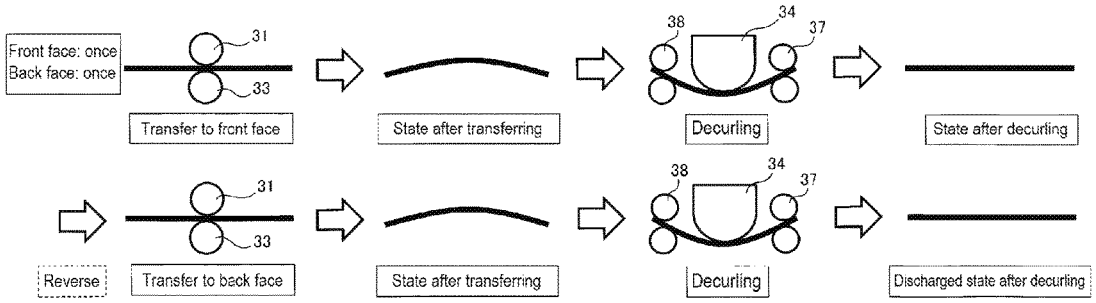
FIG. 20 is an explanatory view schematically illustrating a conventional decurl operation in which decurl processing is performed for each transfer processing at duplex transferring.
Figure 21:
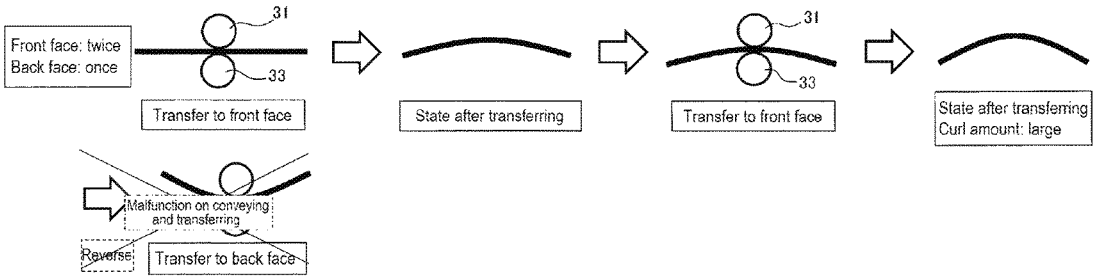
FIG. 21 is an explanatory view illustrating a conventional problem which occurs when transfer processing is continuously performed on a same face of the card without performing decurl processing with the decurl mechanism.

Next, transfer processing with the printing unit B of the printing apparatus 1 according to the present embodiment and decurl processing with the decurl mechanism 10 will be described. When transfer processing is performed on a card-shaped recording medium as in the present embodiment, the card is curled due to contraction of the transfer film 46 transferred to the card. For example, when transfer processing is performed two times continuously on the front face in first, in a case that transfer processing is performed twice on the front face and once on the back face (see FIG. 21), there is a fear that negative influence occurs on conveying and transfer processing on the back face as a curl of the card due to transfer processing is enlarged. This is because even though a curl due transfer processing of one time has no influence, a curl is accumulated to be enlarged when transfer processing is performed twice continuously. Accordingly, conventionally, decurl processing with the decurl mechanism 10 is performed after transfer processing is performed on the front face of the card, as illustrated in FIG. 20. Then, the card is reversed and transfer processing is performed on the back face. Finally, decurl processing with the decurl mechanism 10 is performed again and the card is discharged. However, in the present embodiment, since transfer processing is performed for a plurality of times at least on one face of the card, decurl processing has to be performed for the same times as transferring processing when card issuing is performed with the conventional method. As decurl processing on the card with the decurl mechanism 10 increases, damage to the card may increase.

Figure 7:
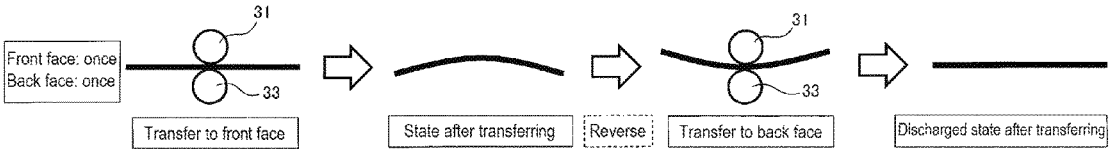
FIG. 7 is an explanatory view of operation during transfer processing according to the embodiment illustrating an example of a case that transfer processing is performed once on a front face of a card and once on a back face.

In the present embodiment, focusing on that a curl is balanced out when transfer processing is performed on the back face with the card reversed after transfer processing is performed once on the front face without performing decurl processing with the decurl mechanism 10 as illustrated in FIG. 7, decurl processing with the decurl mechanism 10 can be suppressed to the minimum by controlling transfer sequence and timing of decurl processing, so that damage to the card can be lessened. In the following, specific examples are described.

First, in a case that transfer processing is performed once on the front face and once on the back face, transfer processing is performed alternately on the front face and the back face. Accordingly, a curl is balanced out, so that the number of times of decurl processing with the decurl mechanism 10 becomes to zero (pattern 1 and pattern 2 in FIG. 13; see FIG. 7).

Figure 8:
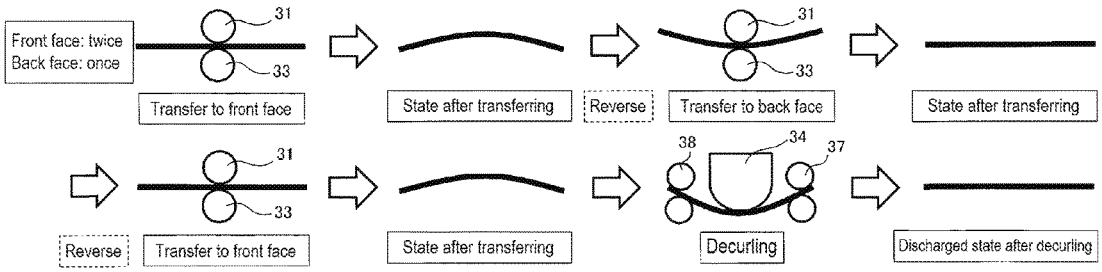
FIG. 8 is an explanatory view of operation during transfer processing according to the embodiment illustrating an example of a case that transfer processing is performed twice on the front face of the card and once on the back face.
Figure 9:
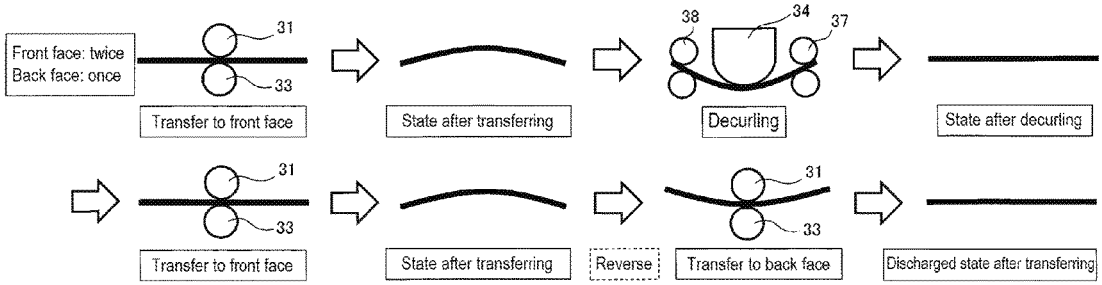
FIG. 9 is an explanatory view of operation during transfer processing according to the embodiment illustrating another example of a case that transfer processing is performed twice on the front face of the card and once on the back face.

Next, in a case that transfer processing is performed twice on the front face and once on the back face, as illustrated in FIG. 8, transfer processing is performed in the order of the front face, the back face, and the front face (pattern 1 in FIG. 14), and then, decurl processing with the decurl mechanism 10 is performed at the end and the card is discharged. In this case, a curl is balanced out through the first transfer processing and the second transfer processing and a curl occurred through the third transfer processing on the front face is corrected with the decurl mechanism 10. As another example, decurl processing with the decurl mechanism 10 may be performed after the first transfer processing while performing transfer processing in the order of the front face, the front face, and the back face (pattern 3 in FIG. 14), as illustrated in FIG. 9, or decurl processing with the decurl mechanism 10 may be performed at the end after performing transfer processing in the order of the back face, the front face, and the front face (pattern 2 in FIG. 14). Thus, decurl processing with the decurl mechanism 10 may be necessary only once while decurl processing is conventionally performed for three times.

Figure 10:
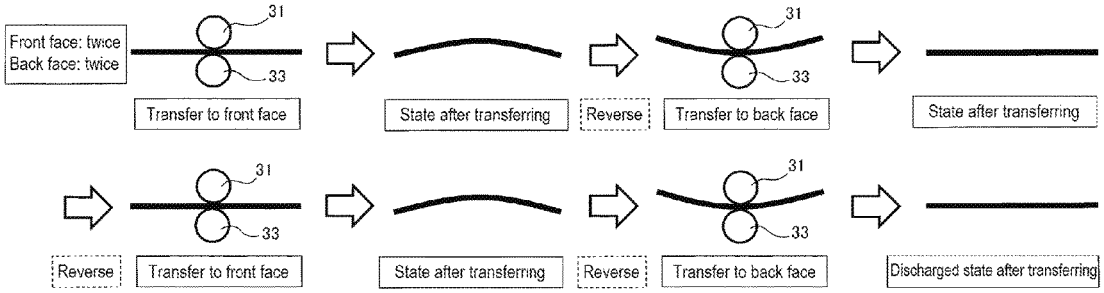
FIG. 10 is an explanatory view of operation during transfer processing according to the embodiment illustrating an example of a case that transfer processing is performed twice on the front face of the card and twice on the back face.

Next, in a case that transfer processing is performed twice on the front face and twice on the back face, as illustrated in FIG. 10, transfer processing is performed in the order of the front face, the back face, the front face, and the back face (pattern 1 in FIG. 15), and then, the card is discharged without performing decurl processing. The number of times of decurling is zero as well when transfer processing is performed in the order of pattern 2 to pattern 4 in FIG. 15. However, as indicated as NG patterns in FIG. 15, in a case that transfer processing is performed in the order of the front face, the front face, the back face, and the back face or in the order of the back face, the back face, the front face, and the front face, decurl processing with the decurl mechanism 10 is required to be performed after the first transfer processing and after the fourth transfer processing, so that the number of times of decurling is two. Accordingly, it is preferable to perform the first transfer processing and the second transfer processing in the order of the front face and the back face or in the order of the back face and the front face and not to perform on the same face continuously as in the order of the front face and the front face or in the order of the back face and the back face. However, even with the NG patterns, the number of times to perform decurl processing is reduced than a conventional method in which decurl processing is performed for each time after transfer processing is performed, so as to be effective compared to the conventional method.

In a case that transfer processing is performed for three times on the front face and twice on the back face, as illustrated in FIG. 11, transfer processing is performed in the order of the front face, the back face, the front face, the back face, and the front face (pattern 1 in FIG. 16), and then, decurl processing with the decurl mechanism 10 is performed at the end and the card is discharged. In this case, a curl is balanced out through the first transfer processing to the fourth transfer processing. Accordingly, decurl processing may be performed once at the end. Further, transfer processing may be performed in the order of the front face, the back face, the back face, the front face, and the front face (pattern 2 in FIG. 16), in the order of the back face, the front face, the front face, the back face, and the front face (pattern 3 in FIG. 16), and in the order of the back face, the front face, the back face, the front face, and the front face (pattern 4 in FIG. 16) as transfer sequence in which the curl is balanced out through the first transfer processing to the fourth transfer processing. When transfer processing is performed in the above sequence, decurl processing with the decurl mechanism 10 may be performed only once at the end. Further, decurl processing may be performed once after the first transfer processing is performed on the front face in pattern 5 of FIG. 16, once after the third transfer processing is performed on the back face in pattern 6 of FIG. 16, and once after the first transfer processing is performed on the front face in pattern 7 of FIG. 16. However, in NG pattern 1 of FIG. 16, decurl processing is necessary to be performed after each of the first transfer processing, the second transfer processing, and the fifth transfer processing for three times in total. Further, in NG pattern 2 of FIG. 16, decurl processing is necessary to be performed after each of the first transfer processing, the fourth transfer processing, and the fifth transfer processing for three times in total. However, even with the NG patterns, the number of times to perform decurl processing is reduced than a conventional method in which decurl processing is performed for each time after transfer processing is performed, so as to be effective compared to the conventional method.

In a case that transfer processing is performed for three times on the front face and once on the back face, as illustrated in FIG. 12, transfer processing is performed in the order of the front face, the back face, the front face, and the front face (pattern 1 in FIG. 17), and then, decurl processing with the decurl mechanism 10 is performed after each of the third transfer processing and the fourth transfer processing for two times in total, and the card is discharged. Similarly, decurl processing may be performed after each of the third transfer processing and the fourth transfer processing in pattern 2 of FIG. 17, after each of the first transfer processing and the fourth transfer processing in pattern 3 of FIG. 17, and after each of the first transfer processing and the second transfer processing in pattern 4 of FIG. 17.

According to the above, making use of that a curl of the card is balanced out when transfer processing is performed alternately on the front face and the back face, the number of times to perform decurl processing with the decurl mechanism 10 can be reduced. In the present embodiment, since decurl processing is performed for the difference between the number of times of transfer processing on the front face and the number thereof on the back face, malfunction of conveying and transferring in the apparatus can be prevented, a discharged card can be prevented from being curled, and damage to the card can be lessened. The number of times of decurling is zero when difference between the number of times of transfer processing on the front face and the number thereof on the back face is zero such as twice on the front face and twice on the back face. The number of times of decurling is one when difference between the number of times of transfer processing on the front face and the number thereof on the back face is one such as three times on the front face and twice on the back face. Further, the number of times of decurling is two when difference between the number of times of transfer processing on the front face and the number thereof on the back face is two such as three times on the front face and once on the back face.

Regarding transfer sequence, a curl is balanced out every two times of transfer processing when transfer processing is performed in the order of the front face and the back face or in the order of the back face and the front face in the first transfer processing and the second transfer processing and in the order of the front face and the back face or in the order of the back face and the front face in the third transfer processing and the fourth transfer processing. Accordingly, it is preferable that transfer processing is performed alternately on the front face and the back face for every two times of transfer processing while the number of times of transferring remains more than one for both of the front face and the back face and that decurl processing with the decurl mechanism 10 is performed when the remaining number of times of transferring becomes to zero for either of the faces. For example, in comparison between patterns 1, 2 and pattern 3, decurl processing is performed after the third transfer processing is performed (before discharging) in patterns 1, 2 but after the first transfer processing is performed in pattern 3. Decurling amount becomes larger in a case that transfer processing is continuously performed on the same face as in pattern 3 compared to a case that transfer processing is performed once on the card after a curl is balanced out as in patterns 1, 2. Then, the whole processing of card issuing becomes time consuming. Accordingly, it is preferable that decurl processing with the decurl mechanism 10 is performed at the end. Here, when difference between the number of times of transfer processing on the front face and the number thereof on the back face is equal to or more than two, it is preferable that transfer processing and decurl processing are repeatedly performed after transfer processing is performed alternately on the front face and the back face in first.

Accordingly, in the present embodiment, transfer processing is started from the face on which the number of times of transferring is larger in accordance with comparison of the number of times of transferring between the front face and the back face, and then, transfer processing is performed alternately on the respective faces. Then, when the remaining number of times of transferring of the face to which the number of times of transferring is smaller becomes to zero, transfer processing and decurl processing with the decurl mechanism 10 is performed alternately. Finally, the card is discharged. Here, in a case that the number of times of transferring is the same for the front face and the back face, a user sets the face to turn up when the card is to be discharged, and the transfer sequence is varied accordingly. For example, when the front face is set to turn up when discharged, the card can be discharged without being reversed as the front face turns up at the time of transfer processing being completed with the order of pattern 1 or pattern 4 in FIG. 15. When the back face is set to turn up when discharged, transfer processing is performed in the order of pattern 2 or pattern 3 in FIG. 15.

[Operation]

Figure 18:
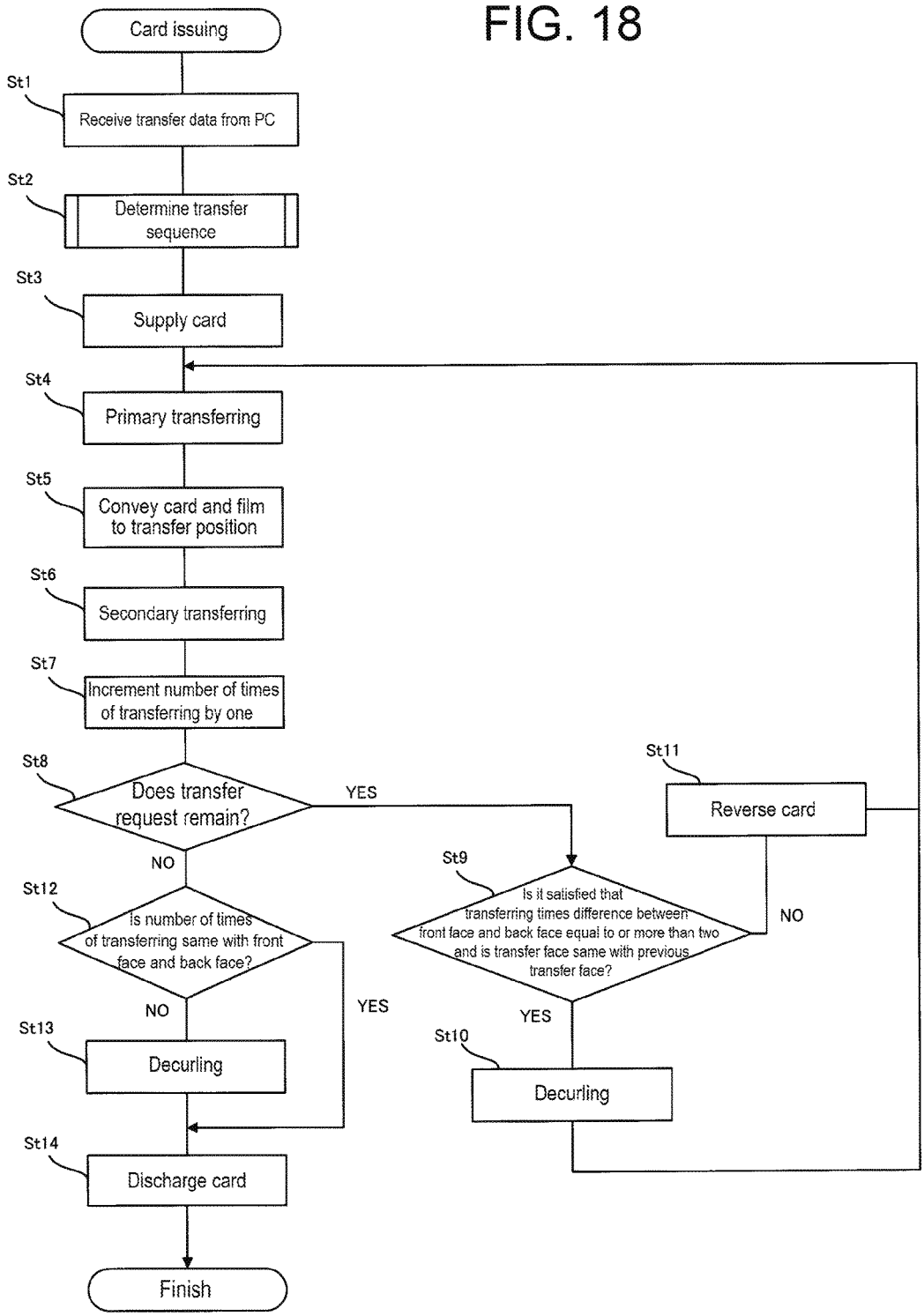
FIG. 18 is a flowchart illustrating a routine for card issuing performed by a CPU of a microcomputer of the controller of the printing apparatus according to the embodiment.
Figure 19:
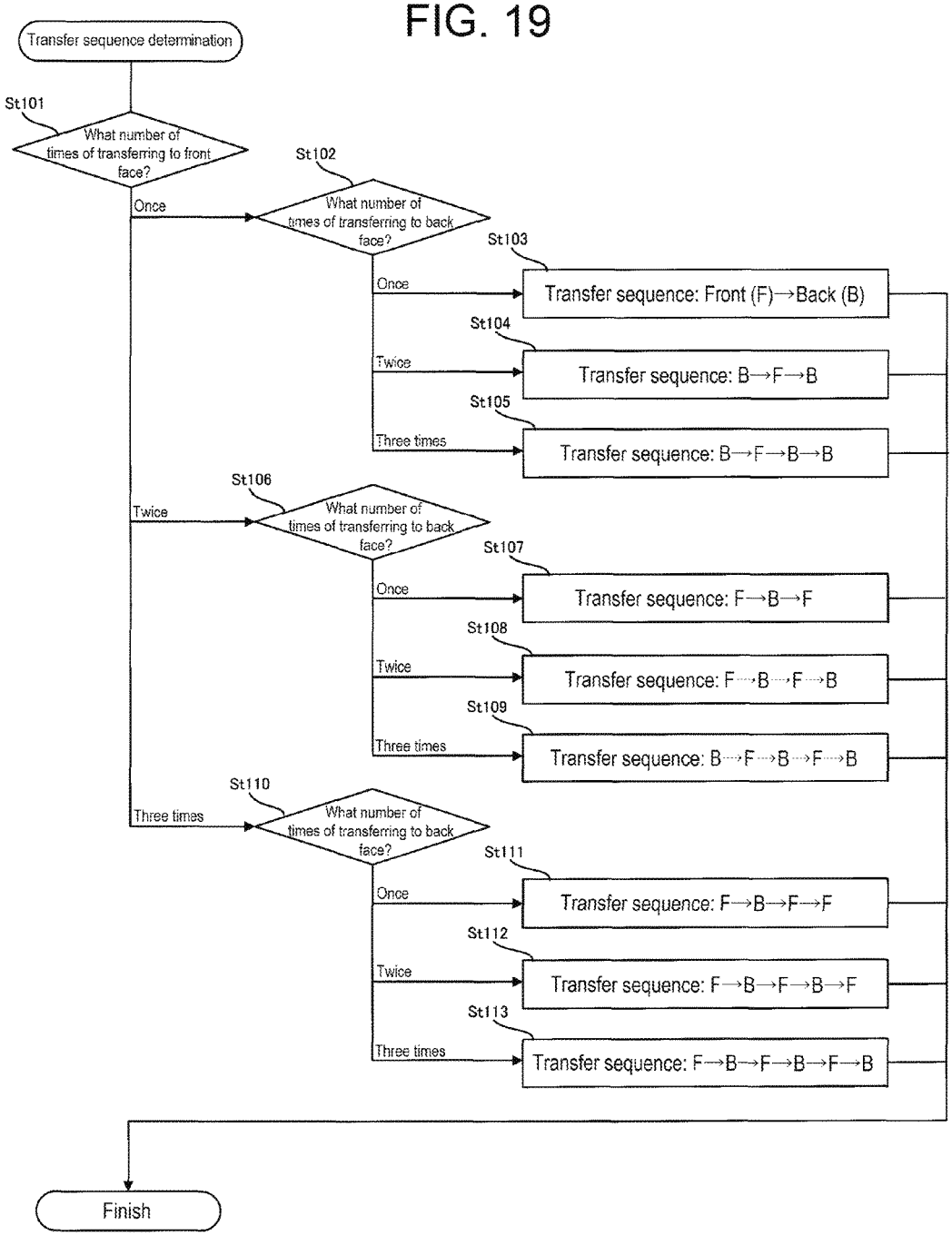
FIG. 19 is a flowchart illustrating a subroutine of transfer sequence determination describing detail of transfer sequence determination processing of a card issuing routine.

Next, a card issuing operation of the printing apparatus 1 of the present embodiment will be described with reference to the flowchart illustrated in FIGS. 18 and 19 mainly on the control of the printing unit B and the decurl mechanism 10 subjectively performed by the CPU of the microcomputer 102 (hereinafter, simply called CPU). Here, the flowchart of the present embodiment illustrates a case in which transfer processing is performed on each of the front face and the back face for three times in maximum. However, the control is similar to a case that transfer processing is performed for four times or more on the respective faces. Further, in the example illustrated in the flowchart, transfer processing is started from the face to which the number of times of transferring is larger in accordance with comparison of the number of times of transferring between the front face and the back face, and then, transfer processing is performed alternately on the respective faces. Then, when the remaining number of times of transferring on the face to which the number of times of transferring is smaller becomes to zero, transfer processing and decurl processing with the decurl mechanism 10 is performed alternately. Finally, the card is discharged. However, transfer sequence and timing of performing decurl processing may be appropriately set as another pattern described above.

First the CPU receives transfer data from the host apparatus (PC) 201 (step St1). Since each of transfer data for the front face of the card and transfer data for the back face is sent from the host apparatus 201, the CPU can perceive the number of times to perform transfer processing on each face. Then, the CPU determines transfer sequence for the card (step St2).

A subroutine of transfer sequence determination will be described with reference to a flowchart illustrated in FIG. 19. First, the CPU judges the number of times of transferring (transfer requirement number from the host apparatus 201) to the front face of the card (step St101). When the number of times of transferring to the front face is one, the CPU judges the number of times of transferring (transfer requirement number) to the back face in step St102. When the number of times of transferring to the back face is one, transfer sequence is set to the order of the front face and the back face (step St103). When the number of times of transferring to the front face is one and the number of times of transferring to the back face is two, transfer sequence is set to the order of the back face, the front face, and the back face (step St104). When the number of times of transferring to the front face is one and the number of times of transferring to the back face is three, transfer sequence is set to the order of the back face, the front face, the back face, and the back face (step St105).

When the number of times of transferring to the front face is judged to be two in step St101, the CPU judges the number of times of transferring to the back face in step St106. When the number of times of transferring to the back face is one, transfer sequence is set to the order of the front face, the back face, and the front face (step St107). Similarly, when the number of times of transferring to the front face is two and the number of times of transferring to the back face is two, transfer sequence is set to the order of the front face, the back face, the front face, and the back face (step St108). When the number of times of transferring to the front face is two and the number of times of transferring to the back face is three, transfer sequence is set to the order of the back face, the front face, the back face, the front face, and the back face (step St109).

When the number of times of transferring to the front face is judged to be three in step St101, the CPU judges the number of times of transferring to the back face in step St110. When the number of times of transferring to the back face is one, the transfer sequence is set to the order of the front face, the back face, the front face, and the front face (step Still). When the number of times of transferring to the front face is three and the number of times of transferring to the back face is two, transfer sequence is set to the order of the front face, the back face, the front face, the back face, and the front face (step St112). When the number of times of transferring to the front face is three and the number of times of transferring to the back face is three, transfer sequence is set to the order of the front face, the back face, the front face, the back face, the front face, and the back face (step St113). Thus, transfer sequence to each face of the card is determined for the transfer data received from the host apparatus, and the subroutine of transfer sequence determination in step St2 is completed.

After transfer sequence is determined in step St2 (or in parallel to the determination), a card is supplied (step St3). Then, image forming processing (primary transferring) is performed on the transfer film 46 at the image forming unit B1 in accordance with the determined transfer sequence (step St4). Subsequently, the transfer film 46 on which image forming is performed and the card are conveyed to and positioned at a transfer starting position at the transfer unit B2 (step St5). In the above state, the transfer roller 33 is moved to the operating position and transfer processing (secondary transferring) is started (step St6). When transfer processing is completed for one time, the number of times of transferring is counted up and stored at the RAM (step St7).

Then, it is determined whether the number of times of transferring counted up in step St7 has reached the required number of times of transferring (step St8). In a case that transfer processing is to be continued, it is determined whether decurl processing with the decurl mechanism 10 is necessary after the current transfer processing (step St9). In this step, it is determined that decurl processing with the decurl mechanism 10 is to be performed when it is satisfied that the difference between the number of times of transfer processing on the front face and the number thereof on the back face is equal to or more than two (e.g., three times on the front face and once on the back face) and that the subsequent transfer processing is to be performed on the same face with the previous transfer processing (i.e., front face and front face or back face and back face). When determined, decurl processing is performed (step St10). For example, when transfer processing is performed in the order of the front face 1, the back face 1, the front face 2, and the front face 3, decurl processing is performed after the third transfer processing is performed (i.e., the front face 2). Since a curl of the card is balanced out through transfer processing on the front face 1 and the back face 1, decurl processing after transfer processing on the front face 1 and the back face 1 is unnecessary. When decurl processing is not performed, the card is reversed (step St11) and kept in a standby state.

When required transfer processing still remains, the control returns to step St4 and steps to step St8 are repeated as forming an image of subsequent printing data on the transfer film 46. When it is determined that all transfer processing requirements are completed at step St8, it is determined whether decurl processing with the decurl mechanism 10 is to be performed before discharging the card (step St12). Here, it is judged whether the number of times of transferring to the front face and the number thereof to the back face are the same. If being the same, a curl of the card is balanced out, so that the card is discharged without performing decurl processing with the decurl mechanism 10 (step St14). When the number of times of transferring is different between the front face and the back face, decurl processing with the decurl mechanism 10 is performed (step St13) and the card is discharged after a curl is corrected (step St14). Thus, the routine of card issuing is completed.

[Effects]

Next, effects of the printing apparatus 1 according to the present embodiment will be described.

According to the printing apparatus 1 of the present embodiment, transfer processing is performed on both faces of a card, for a plurality of times at least on one face of the card. Since decurl processing with the decurl mechanism 10 is unnecessary to be performed for each time after transfer processing is performed owing to that transfer sequence and timing of decurl processing are controlled with the controller 100, damage to the card can be lessened as the number of times of decurl processing is reduced. Here, transfer processing is performed alternately on the front face and the back face for at least once.

Here, the present invention may be applied to a laminating apparatus which includes only the transfer portion B2 without the image forming portion B1. In this case, an image may be previously formed on the transfer film 46 and transfer processing may be performed for a plurality of times on at least one face of the card. Here, the image may be formed on the transfer film 46 with another apparatus, or protection film such as a hologram may be used.

Here, in the present embodiment, the controller 100 determines transfer sequence for the transfer data received from the host apparatus 201. However, the host apparatus 201 (e.g., application or printer driver) may determine transfer sequence and output a command of transfer processing to the printing apparatus 1. Further, the number of times of decurl processing with the decurl mechanism 10 may be smaller than the number of times of transfer processing. The number of times of decurl processing becomes to the minimum when performed for the difference between the number of times of transfer processing on the front face and the number thereof on the back face of the card described in the above embodiment.

What is claimed is:

1. A transfer apparatus, comprising:

a transfer device which performs transfer processing to transfer a transfer layer of a transfer film or a protection film to a face of a card-shaped recording medium, wherein the transfer device performs the transfer processing on a first face of the recording medium and on a second face of the recording medium, the transfer processing being performed on one of the first face and the second face at least twice and the transfer processing being performed on another of the first face and the second face at least once;

a correcting device which performs a decurl processing to correct a curl of the card-shaped recording medium on which the transfer processing has been performed;

a transfer sequence determining device which determines a transfer sequence of performing the transfer processing as to the first face and the second face of the recording medium; and a control device which controls the transfer device and the correcting device, wherein the transfer sequence determining device determines the transfer sequence so that the transfer processing is performed alternately on the first face and the second face of the recording medium at least once, the control device controls the transfer device and the correcting device so that the number of times performing the decurl processing with the correcting device is smaller than the number of times performing the transfer processing, and the control device performs the decurl processing with the correcting device based on a difference between the number of times of the transfer processing on the first face and the second face of the recording medium.

2. The transfer apparatus according to claim 1, further comprising:

a receiving device configured to receive a first face data for performing the transfer processing on the first face of the recording medium and a second face data for performing the transfer processing on the second face of the recording medium.

3. The transfer apparatus according to claim 2, wherein the transfer sequence determining device determines the transfer sequence according to the first face data and the second face data received from the receiving device.

* * * * *